US008813265B2

(12) United States Patent
Schwantes

(10) Patent No.: US 8,813,265 B2
(45) Date of Patent: Aug. 26, 2014

(54) HEADBAND WITH SLOTS

(71) Applicant: Anne Connors Schwantes, New Hope, PA (US)

(72) Inventor: Anne Connors Schwantes, New Hope, PA (US)

( * ) Notice: Subject to any disclaimer, the term of this patent is extended or adjusted under 35 U.S.C. 154(b) by 0 days.

(21) Appl. No.: 13/955,155

(22) Filed: Jul. 31, 2013

(65) Prior Publication Data

US 2014/0033397 A1 Feb. 6, 2014

Related U.S. Application Data

(60) Provisional application No. 61/678,698, filed on Aug. 2, 2012.

(51) Int. Cl.
*A41D 20/00* (2006.01)

(52) U.S. Cl.
CPC ... *A41D 20/00* (2013.01); *Y10S 2/11* (2013.01)
USPC ..... 2/209.13; 2/DIG. 11

(58) Field of Classification Search
CPC ..... A41D 20/00; A41D 23/00; A42B 1/241; A42B 1/247; A42C 5/02; A42C 5/04
USPC ..... 2/DIG. 11, 181, 209.13, 10, 171, 181.6, 2/207; 351/156, 155
See application file for complete search history.

(56) References Cited

U.S. PATENT DOCUMENTS 2,557,552 A 6/1951 Martin
3,173,147 A * 3/1965 Gross et al. ..... 2/452
4,133,604 A * 1/1979 Fuller ..... 351/123
4,179,753 A * 12/1979 Aronberg et al. ..... 2/10
D254,377 S * 3/1980 Czerefkow ..... D16/311
D264,391 S 5/1982 Schweitzer
4,393,519 A 7/1983 Nicastro
D272,865 S 3/1984 Edelmann
4,549,793 A * 10/1985 Yoon ..... 351/156
4,818,094 A * 4/1989 Lyons ..... 351/157
4,918,757 A * 4/1990 Janssen et al. ..... 2/171
5,009,496 A * 4/1991 Holtan et al. ..... 351/156
5,117,510 A 6/1992 Broussard et al.
5,129,106 A 7/1992 Liou
5,188,101 A * 2/1993 Tumolo ..... 128/207.18
5,384,605 A * 1/1995 Escobosa ..... 351/123
D374,114 S 10/1996 Arroyo et al.
D384,789 S 10/1997 Crabb et al.
D385,387 S 10/1997 Berke
5,771,500 A 6/1998 Mayes
5,894,604 A * 4/1999 Crabb et al. ..... 2/209.13
5,930,842 A * 8/1999 Burruss ..... 2/452
6,115,843 A 9/2000 Travalgia
6,237,159 B1 5/2001 Martin
6,298,495 B1 * 10/2001 Totani ..... 2/209.13
6,647,554 B1 * 11/2003 Yan ..... 2/209.13
6,671,885 B2 1/2004 Viggiano
D511,036 S 11/2005 Moses
7,275,270 B2 10/2007 Cotutsca
D571,982 S 7/2008 Kirby
D601,330 S 10/2009 Bishop
D603,145 S 11/2009 Erby
D607,627 S * 1/2010 Kowalczuk ..... D2/876

(Continued)

*Primary Examiner* — Amy Vanatta
(74) *Attorney, Agent, or Firm* — Jason F. Cotter; Archer & Greiner, P.C.

(57) ABSTRACT

A headband with two slots adapted to accommodate the arms of a pair of glasses where the arms are fully contained within pockets leading into the headband.

4 Claims, 2 Drawing Sheets

(56) References Cited

U.S. PATENT DOCUMENTS

D669,633 S 10/2012 Hedgren
2006/0152671 A1* 7/2006 Risso et al. ..... 351/155
2010/0321628 A1* 12/2010 Buggs et al. ..... 351/52

* cited by examiner

HEADBAND WITH SLOTS

CROSS REFERENCE TO RELATED APPLICATION(S)

This application claims the benefit of U.S. Provisional Application No. 61/678,698, filed Aug. 2, 2012.

FIELD OF THE INVENTION

The present invention relates in general to a useful article of attire and in particular to a headband adapted to receive the arms of glasses.

BACKGROUND OF THE INVENTION

Reading glasses, prescription corrective lenses and sunglasses are all among the types of glasses individuals commonly wear. Certain eyewear, such as reading glasses and sunglasses, for example, are removed when they are not in use. Typically, individuals may put the glasses down (and risk misplacing them), may improvise a way to hang the glasses on their clothing (and risk having them fall off), may attach the arms of the glasses to a necklace or slide the glasses above their forehead to rest on top of their forehead. When glasses are resting above the forehead, they can be slid down for easy use, when required, but the glasses are at risk of sliding off an individual's head.

As a further complication, when glasses rest above the forehead, they may collect dirt from oils on the face and hair, thereby requiring frequent cleaning. If the glasses should fall from the head, they are prone to being scratched or destroyed. When glasses rest above the forehead, the hinge connecting the arms of the glasses to the frame can trap hair follicles that may rip or tear the hair out when the glasses are removed from the head.

A need, therefore, exists in the art to provide a way to conveniently place glasses above the forehead when not in use, while at the same time providing a way to secure the glasses to the head without contacting dirt or oil on the skin or hair and further preventing hair from being painfully pulled when the glasses are removed.

SUMMARY OF THE INVENTION

According to the present invention, the foregoing and other objects and advantages are obtained by making a headband comprising a first slot formed between two first overlapping segments of a fabrics and a second slot formed between two second overlapping segments of the fabric, whereby the said first slot and the second slot are spaced apart from one another at a length equal to the distance between two opposing arms of a pair of glasses when said two opposing arms are fully extended; a first pocket formed through the first slot by folding and connecting two first sections of the first overlapping segments of the fabric on top of one another, yet leaving a first unconnected section between the two first sections of the first overlapping segments of the fabric with a diameter at least as large as the diameter of a first arm of the pair of glasses; and a second pocket formed through the second slot by folding and connecting two second sections of the second overlapping segments of the fabric on top of one another, yet leaving a second unconnected section between the two second sections of the second overlapping segments of the fabric with a diameter at least as large as the diameter of a second arm of the pair of glasses.

According to another aspect of the invention, the headband is secured to a wearer's head by tying the fabric in a knot to secure it to a wearer's head

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
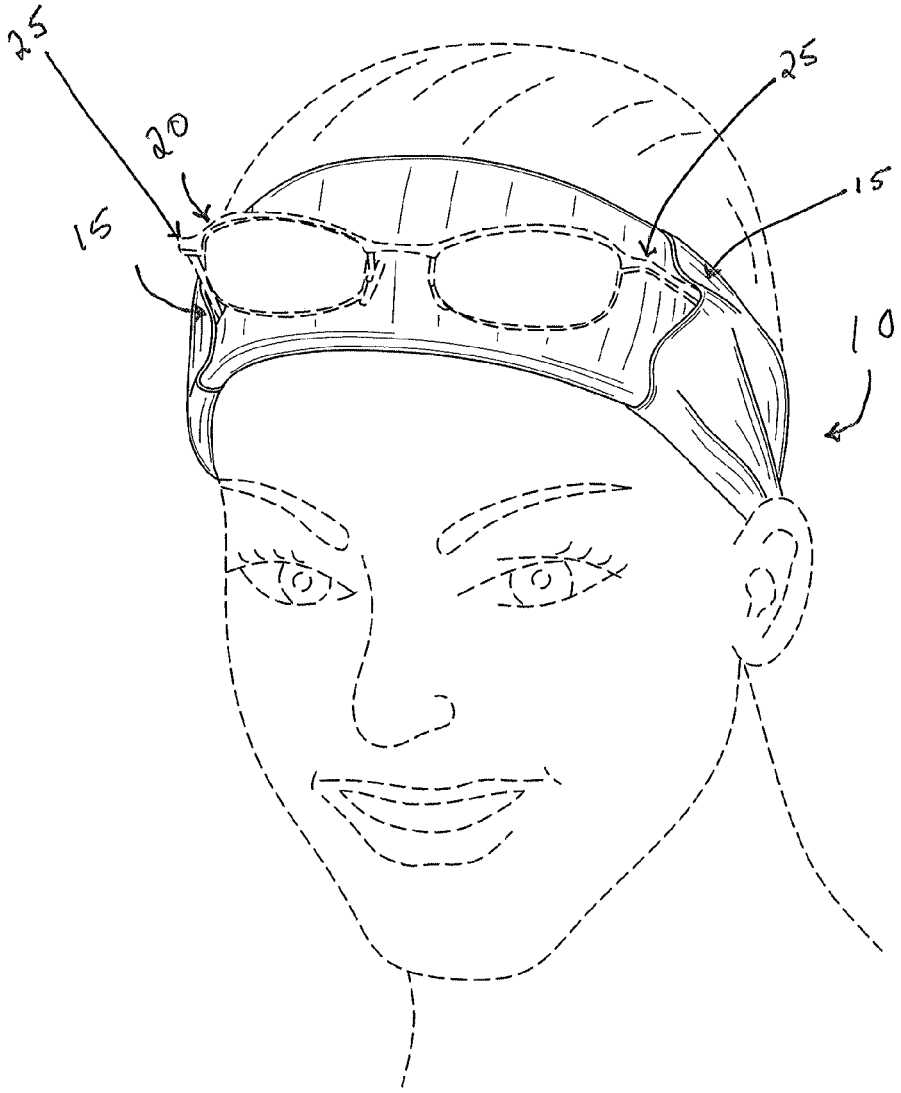
FIG. 1 is a perspective view of a headband receiving a pair of glasses according to one embodiment of the invention.

Referring to the drawings wherein like or similar references indicate like or similar elements throughout the several views, there is shown in FIG. 1 a headband generally identified by reference numeral 10 placed on a human head. In the preferred embodiment, the headband 10 is situated at approximately a 45 degree angle relative to the surface an individual may be standing on such that the top of the headband 10 rests comfortably above the forehead. In this configuration, the opposite end of headband 10 rests near the base of the skull. In other embodiments (not shown), the headband 10 can be worn around the forehead at an alignment substantially parallel to the surface an individual may be standing on. There are a pair of pockets, each generally identified as reference numeral 15. Each pocket 15 is separated from one another at a distance conforming to the length of a typical frame of glasses 20 when the headband is being worn by a user.

The pockets 15 are formed by folding and sewing two pieces of a fabric on top of one another, yet leaving an unsown section in the center of the two lengths of the fabric with a diameter at least as large as the diameter of a typical arm of glasses 20. In this manner, the interior space of each pocket 15 is completely enclosed by fabric. Those having ordinary skill in the art can fashion the pockets 15 in the fabric of headband 10 in any manner known and commonly used for such purpose in this particular art. The fabric can be connected by several other known means other than sewing, including gluing, for example.

In another embodiment, pockets 15 are formed by sewing two separate overlapping fabrics on top of one another, yet leaving an unsown section in the center of the two lengths of the fabrics with a diameter at least as large as the diameter of a typical arm of glasses 20 (not depicted).

The headband 10 is formed from any suitable fabric. In a preferred embodiment, the fabric is a cotton spandex that is breathable, stretchable and comfortable for a user to wear. In other embodiments, nylon, spandex, rayon or any elastic band may be utilized, each by way of non-limiting examples.

In another embodiment, the headband is not a continuous loop of fabric, but is instead secured by tying a length of fabric in a knot to secure it to a user's head. In such an embodiment, the fabric would be longer than the length exemplified in FIG. 1.

As shown in FIG. 1, each opposing arm of a pair of glasses 20 are slid into the opposing pockets 15 when the headband 10 is being worn by a user. In this manner, the hinge joint 25 connecting the arm of glasses 20 to the frame of glasses 20 does not come into contact with an individual's hair. Similarly, the lenses on glasses 20 are abutted against the headband 10, thereby preventing the lenses from contacting a user's hair or skin, as may be the case if the glasses 20 were resting in the same orientation without the use of the headband 10. This is useful to avoid the collection of oils from the skin on the lenses. Furthermore, the arms of glasses 20 are contained within pocket 15 and the arms of glasses 20 are not, therefore, in direct contact with the wearer's hair or skin, thereby preventing the hair from being pulled when the glasses 20 are inserted into or removed from the pockets 15.

Figure 2:
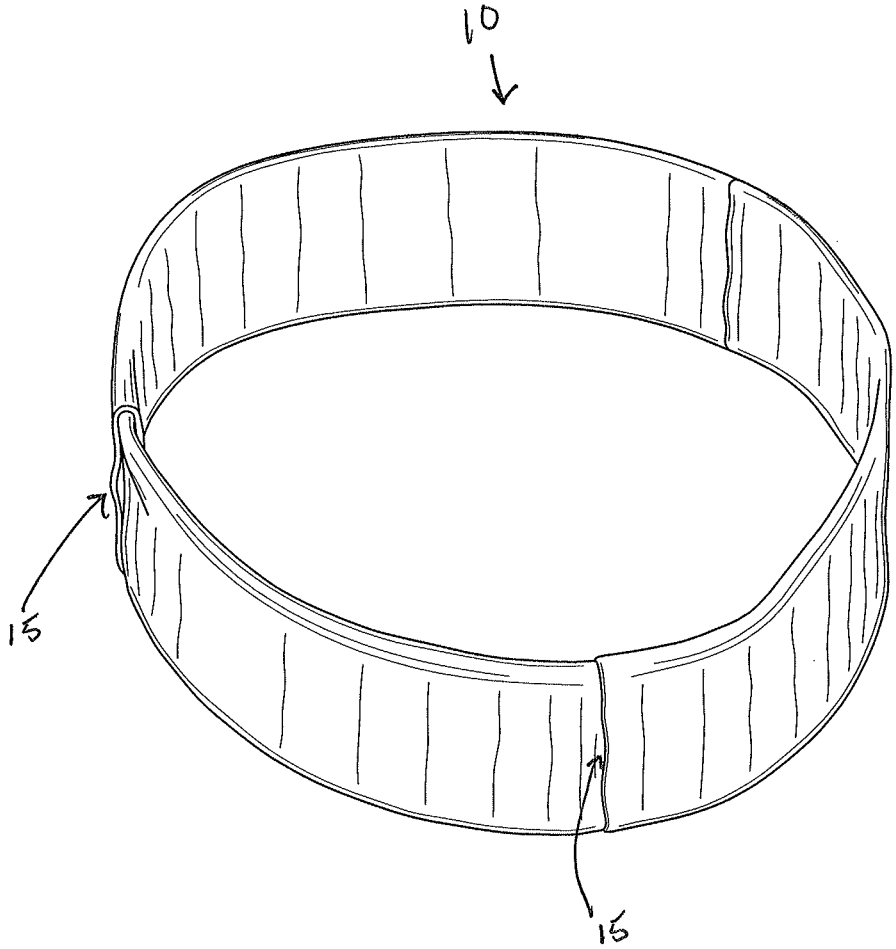
FIG. 2 is a perspective view of a headband without the insertion of glasses according to one embodiment of the invention.

FIG. 2 depicts headband 10 with the pockets 15 empty. The configuration of headband 10 and pockets 15 make it possible for a user to conveniently place glasses 20 in pockets 15 and subsequently remove glasses 20 for use or storage in the manner herein described.

What is claimed is:

1. A headband comprising:

A first slot formed between two first overlapping segments of a fabric and a second slot formed between two second overlapping segments of the fabric, whereby the said first slot and the second slot are spaced apart from one another at a length equal to the distance between two opposing arms of a pair of glasses when said two opposing arms are fully extended;

a first pocket formed through the first slot by folding and connecting two first sections of the first overlapping segments of the fabric on top of one another, yet leaving a first unconnected section between the two first sections of the first overlapping segments of the fabric with a diameter at least as large as the diameter of a first arm of the pair of glasses;

a second pocket formed through the second slot by folding and connecting two second sections of the second overlapping segments of the fabric on top of one another, yet leaving a second unconnected section between the two second sections of the second overlapping segments of the fabric with a diameter at least as large as the diameter of a second arm of the pair of glasses; and the fabric is a circular band that is capable of wrapping around the entire circumference of a wearer's head.

2. The headband of claim 1 wherein the headband is secured to a wearer's head by tying the fabric in a knot to secure it to a wearer's head.

3. A headband comprising:

A first slot formed between two first overlapping segments of two fabrics and a second slot formed between two second overlapping segments of the two fabrics, whereby the said first slot and the second slot are spaced apart from one another at a length equal to the distance between two opposing arms of a pair of glasses when said two opposing arms are fully extended;

a first pocket formed through the first slot by folding and connecting two first sections of the first overlapping segments of the two fabrics on top of one another, yet leaving a first unconnected section between the two first sections of the first overlapping segments of the two fabrics with a diameter at least as large as the diameter of a first arm of the pair of glasses;

a second pocket formed through the second slot by folding and connecting two second sections of the second overlapping segments of the two fabrics on top of one another, yet leaving a second unconnected section between the two second sections of the second overlapping segments of the two fabrics with a diameter at least as large as the diameter of a second arm of the pair of glasses; and the fabrics are circular bands that are capable of wrapping around the entire circumference of a wearer's head.

4. The headband of claim 3 wherein the headband is secured to a wearer's head by tying the two overlapping fabrics in a knot to secure it to a wearer's head.

* * * * *